US006763943B1

(12) United States Patent
Domyan

(10) Patent No.: US 6,763,943 B1
(45) Date of Patent: Jul. 20, 2004

(54) YARN PALETTE

(76) Inventor: Pauline Domyan, 6436 Hayes Dr., Los Angeles, CA (US) 90048

( * ) Notice: Subject to any disclaimer, the term of this patent is extended or adjusted under 35 U.S.C. 154(b) by 0 days.

(21) Appl. No.: 10/056,856

(22) Filed: Jan. 24, 2002

(51) Int. Cl.[7] ..... B65D 85/00; B65D 85/04; B65D 73/00

(52) U.S. Cl. ..... 206/388; 206/49; 206/495

(58) Field of Search ..... 206/388, 6.1, 49, 206/376, 380, 495, 553, 572, 548, 575, 574, 225, 227

(56) References Cited

U.S. PATENT DOCUMENTS

| | | | | | |
|---|---|---|---|---|---|
| 594,519 | A | | 11/1897 | Bristow | |
| 792,563 | A | | 6/1905 | Turner | |
| 1,705,050 | A | * | 3/1929 | Taylor | 206/388 |
| 2,827,247 | A | | 3/1958 | Kraemer | 242/127 |
| 3,856,140 | A | | 12/1974 | Fitts | 206/388 |
| 4,008,806 | A | | 2/1977 | de Paez et al. | 209/122 |
| 4,111,341 | A | | 9/1978 | Carrozo | 223/106 |
| 4,172,521 | A | | 10/1979 | Eubanks et al. | 206/388 |
| 4,264,011 | A | | 4/1981 | Dalbo et al. | 206/574 |
| 4,319,703 | A | | 3/1982 | Gann | 223/106 |
| 4,380,296 | A | | 4/1983 | Murray et al. | 209/704 |
| 4,466,534 | A | * | 8/1984 | Dunn | 206/777 |
| 4,662,517 | A | | 5/1987 | Wirth | 206/388 |
| 4,735,246 | A | * | 4/1988 | Niehaus | 206/6.1 |
| 5,109,578 | A | * | 5/1992 | Cox | 24/298 |
| 5,184,729 | A | | 2/1993 | Zalenski | 206/574 |
| 5,385,237 | A | | 1/1995 | Mathews | 206/574 |
| 5,896,623 | A | * | 4/1999 | Martin | 24/16 PB |
| 5,928,275 | A | * | 7/1999 | Yates et al. | 607/112 |
| 6,196,033 | B1 | * | 3/2001 | Dowdle | 24/16 PB |

* cited by examiner

*Primary Examiner*—Gregory Pickett
(74) *Attorney, Agent, or Firm*—Jeffer, Mangels, Butler & Marmaro LLP

(57) ABSTRACT

A yarn palette is disclosed having a flexible panel with numerous cord locks attached at one end of the panel and extending downwardly therefrom. Each cord lock includes a loop that is adjustable to support any number of skeins provided therein. The yarn palette is used to organize and store a variety of yarns, wherein each cord lock is provided with a particular shade of yarn. The flexible panel can be rolled up into a compact state to facilitate carrying and storage. In a preferred embodiment of the invention, the inside surface of the panel is black to facilitate visual differentiation of similar yarn shades. The panel can also be provided with compartments and pockets for storing notions, tools, specialty yarns or other items.

8 Claims, 4 Drawing Sheets

FIG. 2
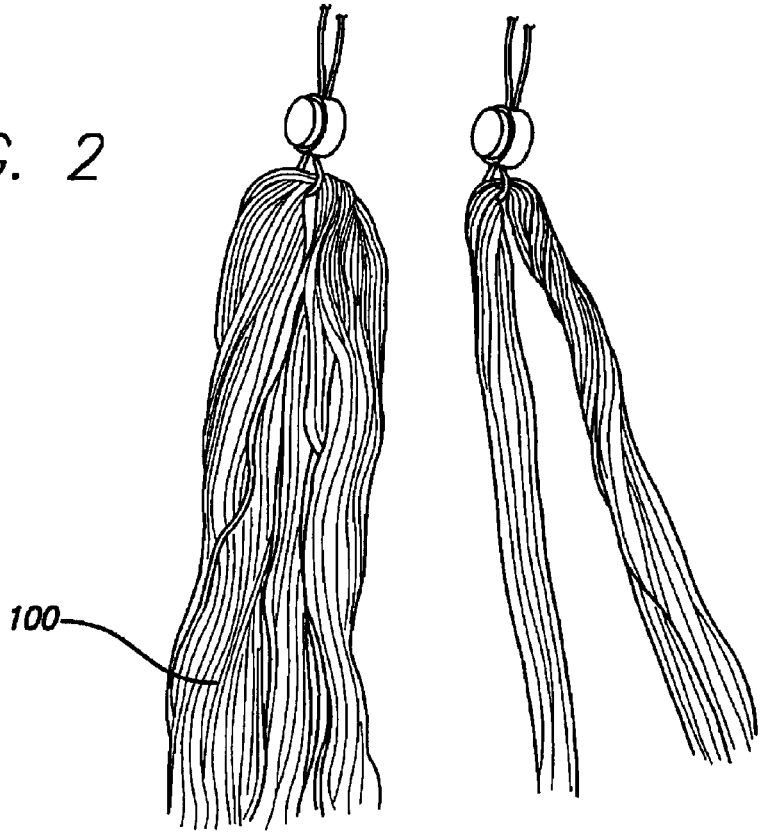
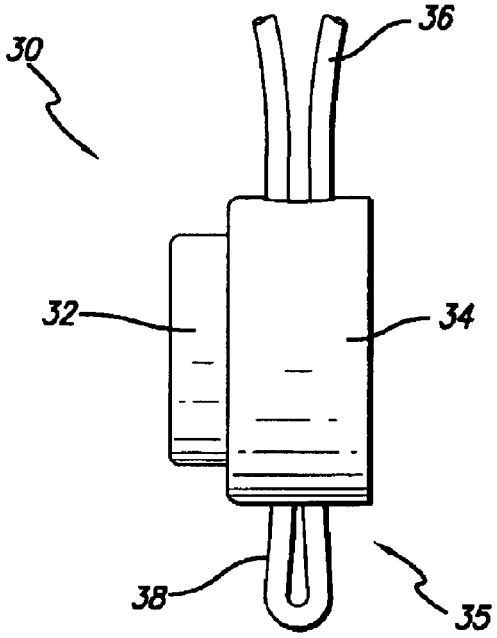
FIG. 3

FIG. 5
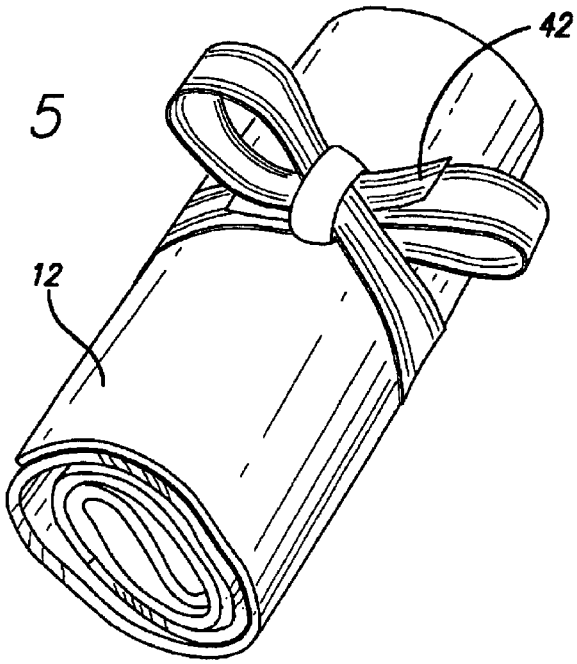
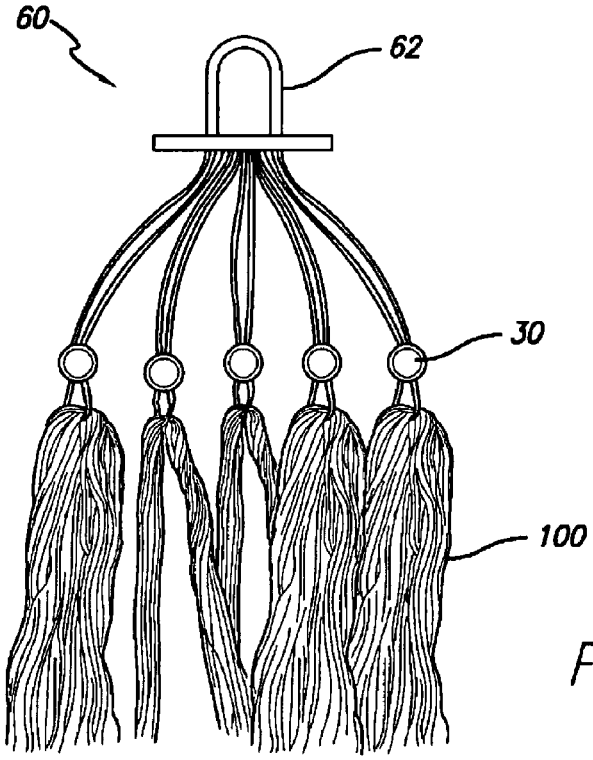
FIG. 6

YARN PALETTE

FIELD OF THE INVENTION

The present invention relates generally to an apparatus for organizing and storing yarns, threads and the like, and more particularly, to a compact, portable yarn palette that maintains various shades of skeins in position for convenient examination and access.

BACKGROUND OF THE INVENTION

When working on a needlework project, e.g., a needlepoint or embroidery project, a person needs to have convenient access to a multitude of skeins, and the ability to examine and expeditiously retrieve a skein of choice. The skeins may be skeins of yarn, thread or the like, hereinafter collectively referred to as "yarn." Due to the enormous variety of available shades of yarn, it is important to be able to store the yarn in an organized fashion.

In the past, individual baggies or boxes have been used to store each shade of yarn. In one known device, a notebook is provided having a number of baggies in the notebook, each baggy containing a shade of yarn. The disadvantage of this known device is that the notebook is bulky. Furthermore, the skeins can get entangled in the baggies, making it more difficult to retrieve a skein when needed. Also, when there are two shades that are very close in color, it is difficult to examine the skeins in the baggies or boxes to appropriately assess the shade of the yarn.

Accordingly, it is desirable to provide a device for storing and organizing strands of yarn that is compact, yet enables the user to store a wide variety of shades of yarn. The yarn should be stored in a manner that would prevent the entanglement of the skeins and allow one to access and retrieve the skeins easily. It would also be desirable if the yarn could be displayed in a manner that would facilitate the examination of the yarn to determine the precise shade.

In another known device, threads of yarn are looped through rings and suspended thereon. A disadvantage of the looping threads through the rings is that the threads tend to slip off of the rings. To ensure that the threads remain on the ring, it is necessary to loosely braid the threads together. However, the braiding interferes with the ability to expeditiously retrieve a single thread from the ring. Accordingly, it is desirable to provide a device that maintains the yarn thereon, and still allows quick retrieval of a single thread when needed.

SUMMARY OF THE PREFERRED EMBODIMENTS

A yarn palette is disclosed for organizing and storing various shades of skeins in position for convenient examination and access. In a preferred embodiment of the invention, the palette includes a flexible panel with numerous cord locks attached at one end of the panel and extending downwardly therefrom. Each cord lock includes a loop that is adjustable to support any number of skeins provided therein. Each cord lock is provided with a particular shade of yarn, whereby the palette organizes the yarn by color.

The flexible panel can be rolled up into a compact state to facilitate carrying and storage. Thus, the palette is able to store a multitude of yarn, in a compact storage configuration. Furthermore, because each shade of yarn hangs from a respective cord lock, the skeins will not be entangled with each other, as they would in a baggy.

In a preferred embodiment of the invention, the inside surface of the panel is black to facilitate visual differentiation of similar yarn shades. The panel can also be provided with compartments and pockets for storing notions, tools, specialty yarns or other items.

In a preferred embodiment of the invention, the flexible panel is lap-sized so that it can be comfortably maintained on a person's lap for use during a needlework project. In another embodiment of the invention, the panel can have an extended length to accommodate additional shades of yarn. If the flexible panel has a length that is larger than lap-sized, the panel can be partially rolled up to expose only a working area containing the shades of yarn needed.

The adjustable cord locks utilized in the present invention can be replaced with other support members that are capable of retaining skeins of yarn while allowing quick retrieval of skeins.

In another preferred embodiment of the invention, numerous adjustable cord locks are fastened together to form a tassel-like palette. A handle is attached to the palette to facilitate the carrying of the palette. Each cord lock preferably supports a shade of yarn and can be adjusted to accommodate the number of skeins provided.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF TH DRAWINGS

The invention may be more readily understood by referring to the accompanying drawings in which:

FIG. 2 depicts a preferred embodiment of the cord locks of the present invention having a number of skeins of yarn therein;

FIG. 3 depicts a side view of a Preferred embodiment of the cord lock of the present invention;

FIG. 5 depicts the yarn palette of FIG. 1 in a rolled up configuration; and FIG. 6 depicts another preferred embodiment of the yarn palette of the present invention.

Like numerals refer to like parts throughout the several views of the drawings.

DETAILED DESCRIPTION OF THE PREFERRED EMBODIMENTS

Figure 1:
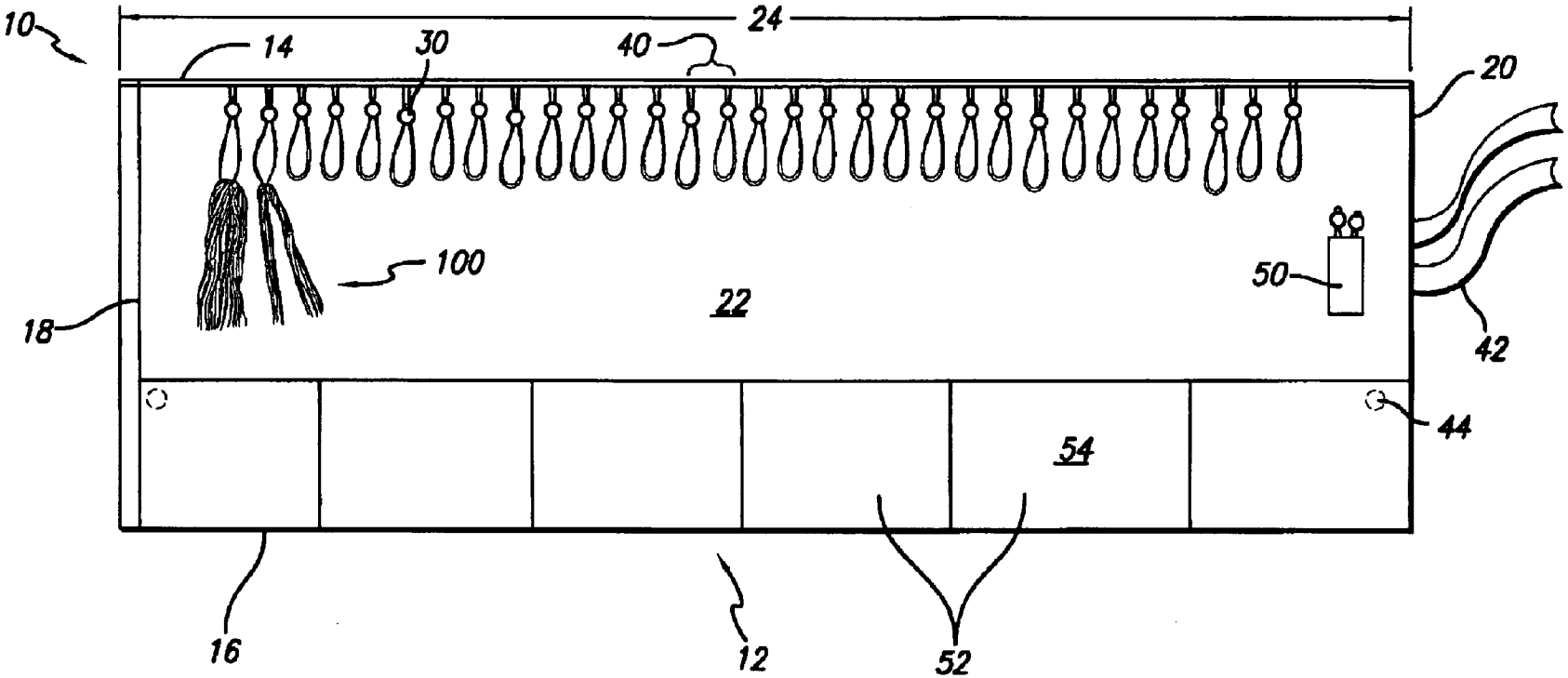
FIG. 1 depicts a preferred embodiment of the yarn palette of the present invention.

As shown in FIG. 1, a preferred embodiment of the yarn palette 10 of the present invention includes a panel 12 having an upper end 14, lower end 16, first side 18 and second side 20. Adjustable cord locks 30 are provided on the inside surface 22 of the yarn palette 10 for holding yarn skeins 100. In a preferred embodiment, each cord lock 30 retains a single shade of yarn.

The cord locks 30 are preferably anchored at the upper end 14 of the panel 12 and extend downwardly therefrom.

The number of cord locks 30 can vary depending on the length 24 of the panel 12 and the preference of the user. In a preferred embodiment of the invention, the cord locks 30 are spaced apart so the skeins of yarn carried by each cord lock 30 do not entangle the neighboring skeins. In a more preferred embodiment, the distance 40 between the cord locks is at least one inch.

As shown in FIG. 3, the adjustable cord locks 30 comprise of an activation button 32, a housing 34 and a cord 36. The activation button 32 is biased in the housing 34 in a manner that securely grips the cord and forms a fastener 35. The cord is threaded through the housing 34 defining a loop 38 that extends outward from the cord lock 30. The size of the loop 38 can be adjusted by varying the location of the fastener 35 on the cord 36. To change the size of the loop 38, the cord lock button 32 is activated, releasing the fastener 35, and the loop 38 is pulled further outward, increasing the size of the loop. When the desired loop size has been achieved, the cord lock button 32 is deactivated, and the fastener 35 again securely engages the cord 36, thus fixing the size of the cord loop. The adjustable cord locks 30 are available commercially through Universal Mercantile Exchange in Baldwin Park, Calif.

Adjustable cord locks are used in a preferred embodiment of the invention because the yarn skeins can be releaseably supported thereon and the loop size of the cord can easily be adjusted to accommodate the quantity of yarn skeins to be held. If there are few skeins, the loop size can be decreased. As the number of skeins increases, the loop size can be increased. FIG. 2 depicts a preferred embodiment of the adjustable cord locks 30 of the invention engaging the yarn skeins 100. At any time, the size of the loop should be sufficiently large to hold the necessary skeins and allow the user to pull out one skein at a time, yet sufficiently small to prevent the skeins from falling out of the loop. Although the adjustable cord locks are used in a preferred embodiment of the invention, other support members can also be substituted.

In one embodiment of the invention, the panel 12 is a page of a notebook or other structure from which the cord locks 30 could hang. The panel 12 could be a rigid structure that is inflexible and not rollable. In a preferred embodiment of the invention, the panel 12 is flexible, and more preferably can be rolled.

Figure 4:
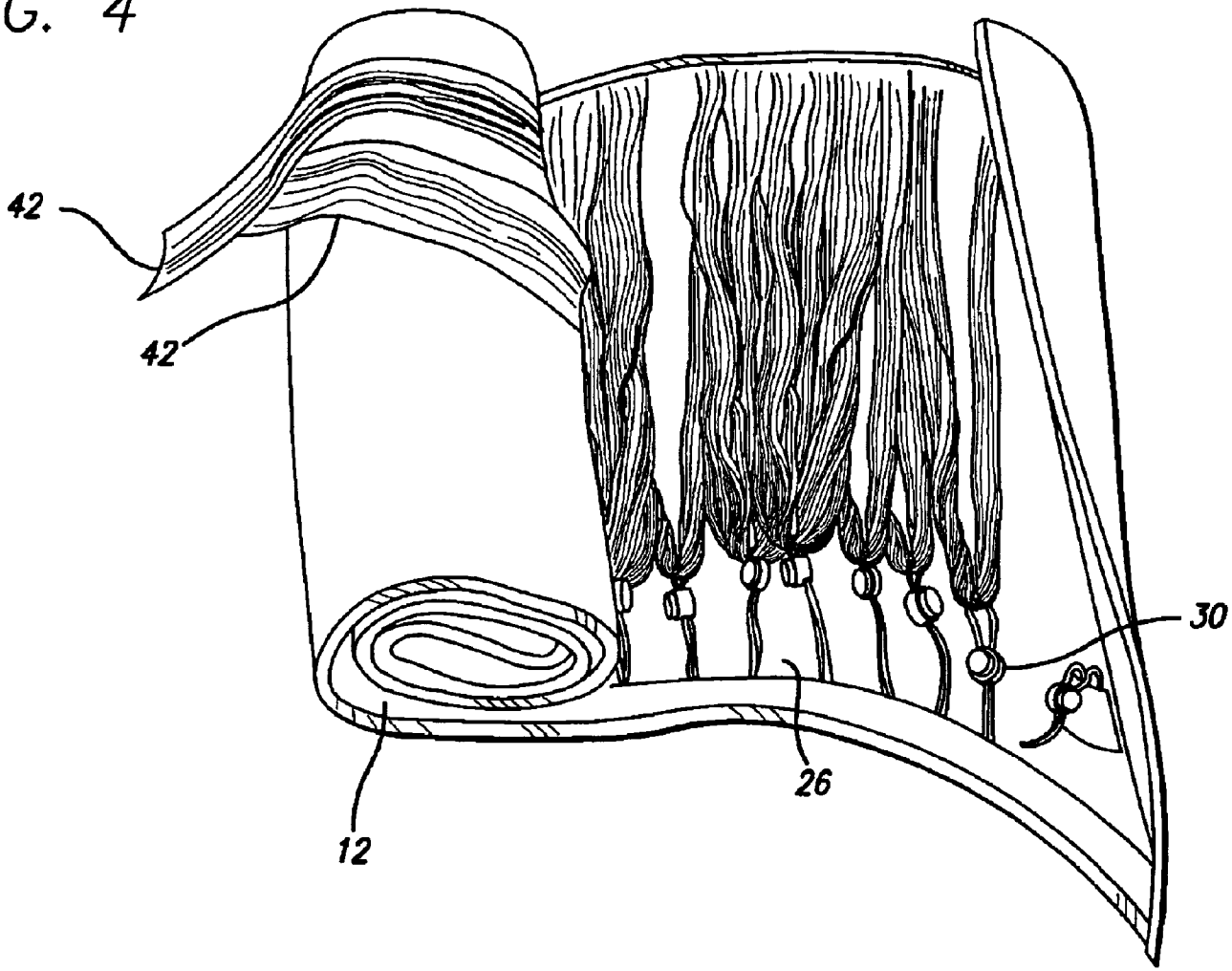
FIG. 4 depicts the yarn palette of FIG. 1 in a partially rolled up configuration.

The size of the panel 12 may vary. In one embodiment of the invention, the flexible panel 12, in a rolled out configuration is lap-sized so that it can comfortably be maintained on a person's lap for use during a needlework project. In another embodiment of the invention, the flexible panel 12 has an extended length to accommodate additional shades of yarn. In embodiments wherein the flexible panel 12 has a length 24 that is larger than lap-sized, the panel can be rolled up, as shown in FIG. 4, to expose only a working area 26 containing the shades of yarn needed for a particular part of the project. If the working area 26 is not near one the ends 18, 20 of the flexible panel, both ends 18 and 20 could be rolled up, exposing the working area 26 at the center portion of the flexible panel 12.

The panel 12 is preferably made of a flexible material that can be rolled up, and more preferably is made of cloth. As best shown in FIG. 4, the panel is rollable into a compact state and includes end ties 42 at one end thereof which may be encircled and releasably secured about the panel when in a rolled state. In the embodiment shown in FIG. 4, the end ties 42 are knotted together to maintain the panel in a rolled up state. In other embodiments of the invention, the end ties can be bound together using known fasteners.

Referring to FIG. 1, the inside surface 22 of panel 12 is preferably black to facilitate the visual detection of the different shades of colors that are laid thereon. The shades of yarn can be very similar such that is difficult for a person to see the difference between two similar shades. By providing a black background, the yarn palette of the present invention assists the user in visually differentiating between yarns of similar shades.

The material used on the inside surface 22 of panel 12 is preferably a material that does not wear on the yarn, cause the skeins to deteriorate in any manner or cause the skeins to get entangled. In a preferred embodiment of the invention the inside surface 22 of panel 12 is made of a smooth, black cloth material.

In a preferred embodiment of the invention, panel 12 includes compartments 50 for storing various sewing tools. For example, as shown in FIG. 1, compartment 50 is dimensioned to hold scissors. Additional compartments may be provided that are dimensioned to store a variety of sewing notions and tools, such as thimbles or needle threaders. The number of compartments should be limited such that the storage of notions and tools does not interfere with the ability to roll up the flexible panel into a compact state.

Further storage space can be provided in the form of pockets 52. As shown in FIG. 1, pockets 52 are preferably provided at the lower end 16 of the panel 12. The pockets can be used for storing such items as yarn scraps or specialty yarns that are not sold in skeins. The number of panels may vary. In the embodiment shown, pockets 52 are provided along the entire length 24 of the panel. The pockets 52 can be fixedly attached to the inside surface 22 of the panel or can be releaseably attached thereto using snaps, buttons, velcro fasteners or other known fasteners 44. In a preferred embodiment of the invention, the outer surface 54 of the pocket is made of the same material as the inside surface 22 of the panel. The inside surface 56 of the pockets is preferably made of a clear plastic material to enable the user to see the contents of the pockets 52 and to facilitate the cleaning of the pockets.

In another preferred embodiment of the invention, as shown in FIG. 6, the yarn palette 60 includes numerous cord locks 30 fastened together to form a tassel-like palette. A handle 62 is preferably attached to the palette to facilitate the carrying of the palette. Each cord lock 30 supports a shade of yarn and can be adjusted to accommodate the number of skeins 100 provided, as described above.

The embodiments described above are exemplary embodiments of a yarn palette Those skilled in the art may now make numerous uses of, and departures from, the above-described embodiments without departing from the inventive concepts disclosed herein. Accordingly, the present invention is to be defined solely by the scope of the following claims.

What is claimed is:

1. A yarn organizer tool for carrying and storing skeins of yarn, comprising:

a flexible, rollable panel having an inside surface;

a plurality of cord locks adjustably dimensioned to receive skeins of yarn, each cord lock attached to the inside surface of the panel, wherein each cord lock comprises an adjustable loop and a locking means, the loop configured to receive usable lengths of skeins therethrough, the locking means having a lock position and a release position, wherein in the release position, the loop can be adjusted in size and wherein in the lock position, the loop is not adjustable;

a compact state wherein the flexible panel is rolled;

and a pair of end straps attached to the panel, wherein in the compact state, the end straps encircle the panel and releasably secure the panel.

2. The yarn organizer tool of claim 1 wherein the inside surface is black.

3. The yarn organizer tool of claim 1 wherein the flexible panel comprises a cloth material.

4. The yarn organizer tool of claim 1 further comprising a pocket attached to the inside surface of the panel.

5. The yarn organizer tool of claim 4 wherein the pocket is dimensioned to receive scissors.

6. The yarn organizer tool of claim 4 wherein the pocket is releasably secured to the inside surface of the panel by a fastener.

7. A method of storing skeins, comprising the steps of:

providing a yarn organizer having a flexible panel and a plurality of cord locks thereon, wherein each cord lock includes a loop and an adjustable fastener for varying the size of the loop;

threading the usable lengths of skeins through the loop of the cord lock;

adjusting the fastener to securely retain the skeins in the loop while allowing retrieval of individual lengths of skeins; and rolling the yarn organizer into a compact state.

8. The method of claim 7 wherein in the compact state, the rolled panel is encircled by straps.

* * * * *